US005692922A

United States Patent [19]

Pfeiffer et al.

[11] Patent Number: 5,692,922

[45] Date of Patent: Dec. 2, 1997

[54] MOLDING WITH ELECTRICAL CONTACT

[75] Inventors: Bernhard Pfeiffer, Kelkheim; Detlef Skaletz, Mainz, both of Germany

[73] Assignee: Hoechst Aktiengesellschaft, Frankfurt, Germany

[21] Appl. No.: 321,109

[22] Filed: Oct. 11, 1994

[30] Foreign Application Priority Data

Oct. 13, 1993 [DE] Germany ..... 9315490 U

[51] Int. Cl.[6] ..... H01R 4/24

[52] U.S. Cl. ..... 439/421; 439/91

[58] Field of Search ..... 439/387, 435, 439/442, 444, 741, 870, 607–608, 86–88, 91, 795, 422, 799, 800, 66; 174/35 R

[56] References Cited

U.S. PATENT DOCUMENTS

| | | | |
|---|---|---|---|
| 3,305,623 | 2/1967 | Bakker et al. | 174/35 MS |
| 3,504,101 | 3/1970 | Muto . | |
| 3,715,705 | 2/1973 | Kuo | 439/422 |
| 3,761,867 | 9/1973 | Chura . | |
| 3,818,415 | 6/1974 | Evans et al. . | |
| 3,846,577 | 11/1974 | Kuo . | |
| 3,891,293 | 6/1975 | Jones | 439/422 |
| 4,248,493 | 2/1981 | Kuo | 439/422 |
| 4,412,255 | 10/1983 | Kuhlman et al. | 358/245 |
| 4,551,579 | 11/1985 | Takasaki | 439/422 |
| 4,820,170 | 4/1989 | Redmond et al. | 439/91 |
| 5,001,302 | 3/1991 | Atsumi et al. | 439/91 |
| 5,101,553 | 4/1992 | Carey et al. | 439/91 |
| 5,140,405 | 8/1992 | King et al. | 439/91 |
| 5,174,766 | 12/1992 | Yoshizawa et al. | 439/91 |
| 5,211,567 | 5/1993 | Neumann et al. | 439/74 |

FOREIGN PATENT DOCUMENTS

| | | | |
|---|---|---|---|
| 0365376 | 4/1990 | European Pat. Off. | 439/422 |
| 1665548 | 3/1971 | Germany . | |
| 2911575 | 3/1979 | Germany | 439/799 |
| 2070347 | 2/1980 | United Kingdom | 439/422 |

OTHER PUBLICATIONS

Research Disclosure, No. 272, Dec. 1986, entitled "Ground Network Insert for Polymer Containing Conductive Fibers", disclosed anonymously.

*Primary Examiner*—P. Austin Bradley
*Assistant Examiner*—Jill DeMello
*Attorney, Agent, or Firm*—Curtis, Morris & Safford P.C.

[57] ABSTRACT

An electrically conducting molding comprises thermoplastic material which is reinforced with metal fibers. A metal covering is connected to the molding by three-cornered prongs and serves as an electric contact.

20 Claims, 3 Drawing Sheets

Fig. 1
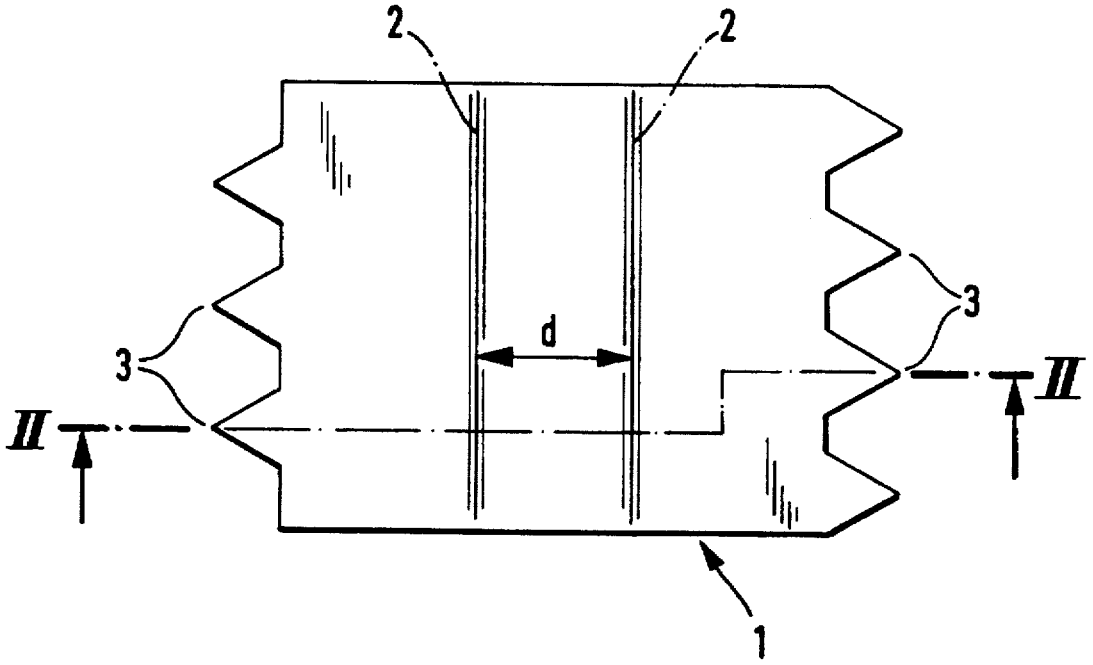
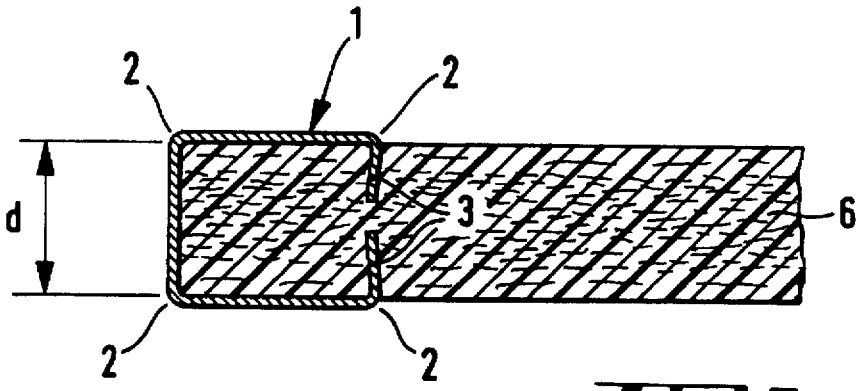
Fig. 2

MOLDING WITH ELECTRICAL CONTACT

FIELD OF THE INVENTION

The invention relates to a molding of a metal fiber reinforced thermoplastic material which has at least one electric contact. (For example grounding).

BACKGROUND OF THE INVENTION

Thermoplastic materials which are filled with metal fibers are used, inter alia, for heating elements (heating conductors for panel heating), shielding housings and antistatically finished components. In the production of such moldings by injection molding or by extrusion, the conductive metal fibers do not come right to the surface. The layer depleted of metal fibers and less conductive which forms at the surface makes it more difficult to provide electric contacts. This problem does not occur on surfaces which have been produced by sawing. Therefore, electric contacts are usually provided by drilling the moldings and subsequently pressing in metal bushes or metal pins or by screwing in self-tapping metal screws. These known methods of providing contacts are labor intensive and material intensive, in particular if relatively large contact areas are required. The object was therefore to provide an electrically conductive molding with electric contacts which is easy to produce.

SUMMARY OF THE INVENTION

There has now been found a molding of a thermoplastic material filled with metal fibers, with at least one electric contact, wherein the contacts comprise a metal covering which is fastened in the surface of the molding by three-cornered prongs or by means of metal chips. Prior drilling is not required. The prongs preferably form isosceles triangles. If the moldings of thermoplastic material have the form of a board, the metal covering is preferably to be clamped at 2 opposite points of the board. The prongs are preferably arranged offset in the 2 opposite legs of the clamp. If the molding is cylindrical, the metal covering may have the form of a pipe clip which encloses the circumference of the cylinder. The moldings to be provided with contacts may, for example, be housing parts and other injection moldings, such as grips, wheels or buttons. The electric contacts make it possible to heat these parts electrically.

BRIEF DESCRIPTION OF THE DRAWINGS

FIG. 1 shows a one-piece clamp (1) with prefabricated bending edges (2) and offset triangular prongs (3), which drill into the interior of a board through the less conductive (outer) layers when the metal clamp is pressed together. The distance d corresponds to the thickness of the board (6) to which the metal clamp is to be applied. FIG. 2 shows a cut through a molding (6) in board form of the thickness d on whose edge the metal clamp (1) is fastened by the prongs 3 along line II—II of FIG. 1.

Figure 3:
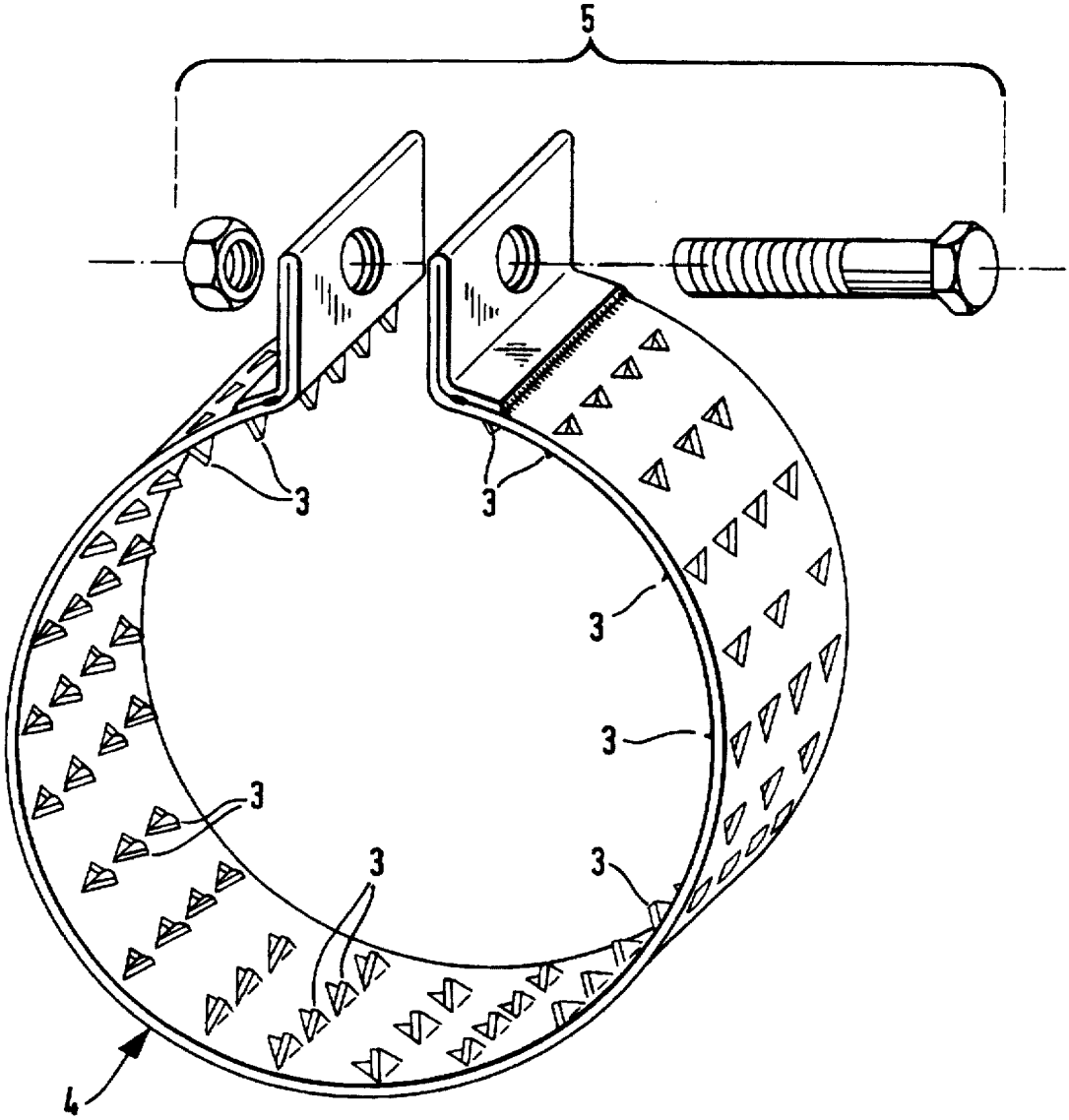
FIG. 3 shows a metal clamp (4) in the form of a hose clamp with triangular prongs (3) and a clamping device (5). When (5) is drawn together, the prongs (3) drill into the surface of a cylindrical molding (not shown) of thermoplastic material.
Figure 4:
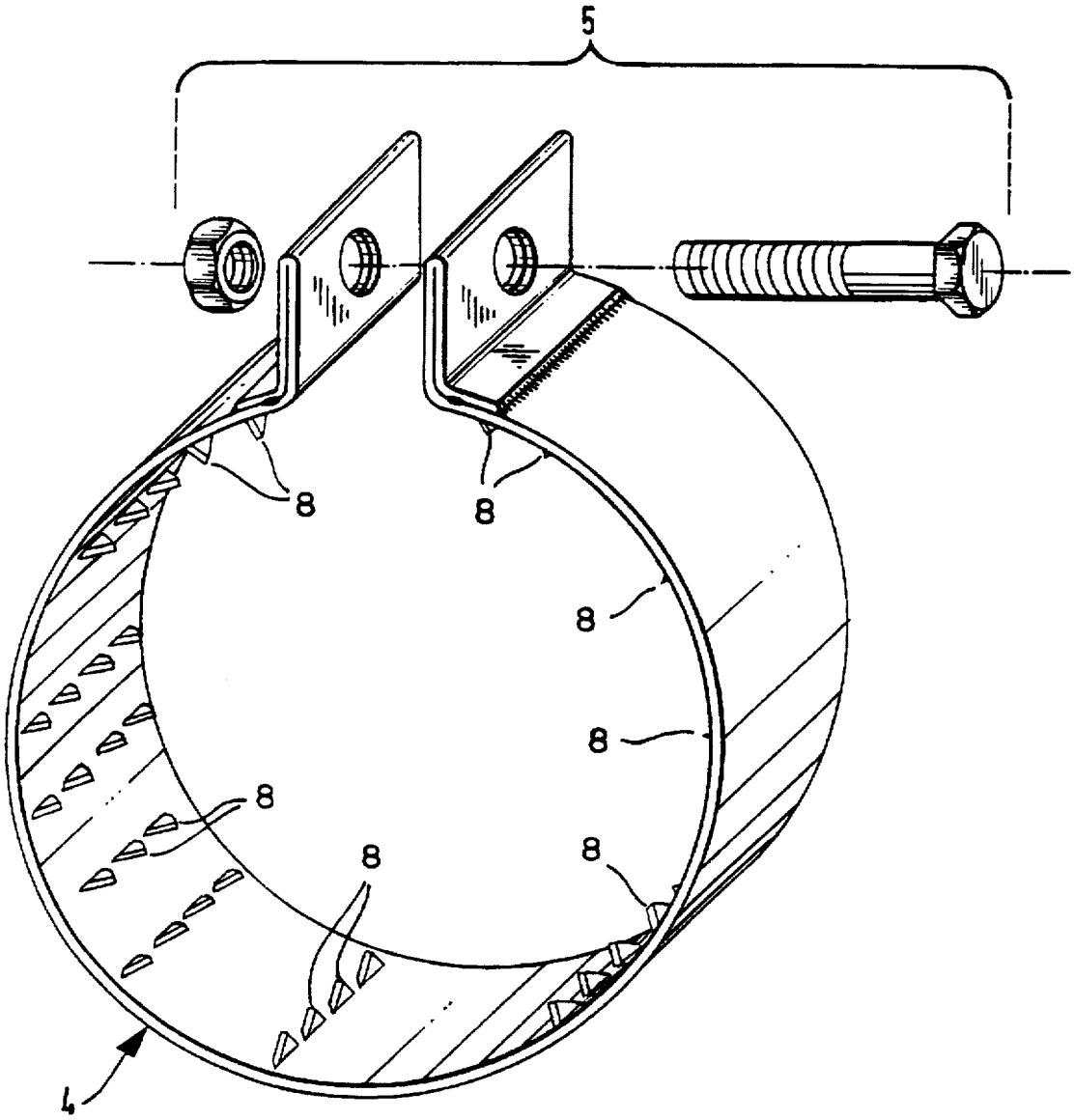
FIG. 4 shows a metal clamp (4) in the form of a hose clamp with the metal chips (8) and a clamping device (5). When (5) is drawn together, the metal chips (8) drill into the surface of cylindrical molding (not shown) of thermoplastic material.

The prongs may be replaced very advantageously, since inexpensively, by metal chips, which are scattered on to the surface at the contact point, and like the prongs penetrate the surface when the metal clamp or pipe clip is closed. The metal chips are preferably of brass or high-grade steel. Their dimensions are to be great enough for the nonconducting surface of the moldings to be penetrated. Preferably, metal chips 1 to 3 mm in size are scattered on to the molding and pressed in. In all cases, a heating of the surface facilitates the penetration of the prongs or chips.

The content of the randomly dispersed metal fibers in the thermoplastic material is preferably less than 20% by weight, in particular 5 to 10% by weight. In addition, the molding may be reinforced by glass fibers to increase the mechanical strength. An addition of carbon black may increase slightly the electric conductivity.

Steel fibers, in particular high-grade steel fibers, are preferably used as metal fibers. The metal fibers preferably have a length of 1 to 20 and a thickness of 5 to 15 μm. The thermoplastic material is preferably selected from the group of amorphous thermoplastics, such as polycarbonate and acrylonitrile/butadiene/styrene copolymers, PC/ABS blends or semi-crystalline thermoplastics such as polypropylene, nylon 66, polybutyleneterephthalate or polyphenylene-sulfide.

We claim:

1. A molding of a thermoplastic material reinforced with metal fibers which are randomly dispersed throughout the thermoplastic material and thereby render the material electrically conductive, with at least one electric contact, wherein the at least one electric contact comprises a metal covering which is connected to the molding by three-cornered prongs, wherein penetration of the prongs is facilitated by heating the surface of the thermoplastic material.

2. The molding as claimed in claim 1, wherein the prongs have the form of isosceles triangles.

3. The molding as claimed in claim 1, wherein the molding is cylindrical and the metal covering has a pipe clip form.

4. The molding as claimed in claim 1, wherein the covering wraps around a portion of the molding.

5. The molding as claimed in claim 1, wherein penetration of the prongs is into a surface of the thermoplastic material which is warm from processing.

6. The molding as claimed in claim 1, wherein the thermoplastic material contains less than 20% by weight metal fibers.

7. The molding as claimed in claim 1, wherein the thermoplastic material further comprises glass fibers.

8. The molding as claimed in claim 1, wherein said molding comprises a non-conducting surface layer depleted of metal fibers and said prongs penetrate the non-conducting surface layer.

9. The molding as claimed in claim 1, wherein the molding has the form of a board and the metal covering is clamped on at least two sides of the board.

10. The molding as claimed in claim 9, wherein the three-cornered prongs of the metal covering are arranged offset on at least two sides of the board.

11. The molding as claimed in claim 1, wherein the thermoplastic material contains 5 to 10% by weight metal fibers.

12. The molding as claimed in claim 11, wherein said thermoplastic material further comprises glass fibers.

13. A molding of a thermoplastic material reinforced with metal fibers which are randomly dispersed throughout the thermoplastic material and thereby render the material electrically conductive, with at least one electric contact, wherein the at least one electric contact comprises a metal covering which is connected to the molding by means of metal chips which penetrate a surface of the thermoplastic material, wherein penetration of the metal chips is facilitated by heating the surface of the thermoplastic material.

14. The molding as claimed in claim 13, wherein penetration of metal chips is into a surface of the thermoplastic material which is warm from processing.

15. The molding as claimed in claim 13, wherein the metal chips comprise brass or steel.

16. The molding as claimed in claim 13, wherein the thermoplastic material contains less than 20% by weight metal fibers.

17. The molding as claimed in claim 13, wherein the thermoplastic material contains 5 to 10% by weight metal fibers.

18. The molding as claimed in claim 13, wherein the thermoplastic material further comprises glass fibers.

19. The molding as claimed in claim 13, wherein the metal chips are 1 to 3 mm in size.

20. The molding as claimed in claim 19, wherein said thermoplastic material contains less than 20% by weight metal fibers.

* * * * *